US005234657A

United States Patent [19]

Hong

[11] Patent Number: 5,234,657

[45] Date of Patent: Aug. 10, 1993

[54] METHOD OF MAKING STRING HOLES IN A SPORTS RACKET FRAME

[76] Inventor: Arthur Hong, No. 96, Sec. 4, Pei-Ping Rd., Taichung City, Taiwan

[21] Appl. No.: 739,366

[22] Filed: Aug. 2, 1991

[51] Int. Cl.[5] ..... B29C 45/14

[52] U.S. Cl. ..... 264/516; 273/73 R; 273/73 C; 273/73 D; 264/314; 264/257; 264/258

[58] Field of Search ..... 273/73 R, 73 C, 73 D, 273/73 F; 264/314, 512, 516, 257, 258

[56] References Cited

U.S. PATENT DOCUMENTS

| | | | |
|---|---|---|---|
| 4,061,520 | 12/1977 | Cecka et al. | 273/73 F X |
| 4,264,389 | 4/1981 | Staub et al. | 273/73 F X |
| 4,614,626 | 9/1986 | Frerking | 273/73 F X |
| 4,891,175 | 1/1990 | Haines | 264/278 X |
| 4,935,185 | 6/1990 | Mott | 264/314 X |
| 4,981,639 | 1/1991 | Mott | 264/516 X |

FOREIGN PATENT DOCUMENTS

| | | | |
|---|---|---|---|
| 0168993 | 1/1986 | European Pat. Off. | 273/73 C |
| 0202834 | 11/1984 | Japan | 264/516 |
| 2056863 | 3/1981 | United Kingdom | 273/73 C |

*Primary Examiner*—V. Millin
*Assistant Examiner*—Raleigh W. Chiu
*Attorney, Agent, or Firm*—Browdy and Neimark

[57] ABSTRACT

The method of making a sports racket frame with improved string holes includes a predetermined number of insertion pins pre-arranged in the molding cavity. The inner wall surface of the molding cavity adjacent to each insertion pin is filled with the fiber cement made of materials identical in quality with those making up the tubular strip used to form the racket frame. The sports racket frame so attained is composed of string holes which are integrally and simultaneously made with the racket frame as a unitary body and are provided with tubular support wall extending along the circumference thereof to reinforce the structural strength of the racket frame.

9 Claims, 5 Drawing Sheets

METHOD OF MAKING STRING HOLES IN A SPORTS RACKET FRAME

BACKGROUND OF THE INVENTION

The present invention relates to a sports racket, and more particularly to a sports racket designed with a frame having improved string holes and to the method of making such string holes.

As exemplified by Martel in the French Patent Number 2276845, Svoma in the U.S. Pat. No. 4,802,678, and Newsome in the U.S. Pat. No. 4,076,241, various attempts have been made to enhance the strength of a sports racket frame. They all disclosed sports racket frames, which are reinforced by means of increasing thereto an additional thickness and are composed of two rows of string holes arranged at different levels in the circumference thereof to receive therein the strings so that the portion of the netted surface adjacent to the frame is made slightly oblique in order to enhance the ball-controlling capabilities of the racket.

Nowadays sports racket frames are made of carbonaceous fiber material in order to reduce the weight thereof at the expense of the strength thereof. The strength of a racket frame made of carbonaceous fiber is compromised by the string holes punched therethrough. As a result, a sports racket frame as such is vulnerable to breakage.

SUMMARY OF THE INVENTION

It is therefore the primary objective of the present invention to provide a sports racket frame, made of a composite material, with improved string holes and to provide the method of making such string holes.

In keeping with principles of the present invention, the primary objective of the present invention is accomplished by a sports racket frame which is characterized in that it is composed of string holes made integrally as parts of a unitary body of the racket frame. The string hole so made is composed of a tubular support wall located along the circumference thereof. In other words, the tubular support wall serves to reinforce the structural strength of the head frame and to enclose the portion of the string which passes through the hole. The tubular support wall of the string hole and the head frame are made integrally as a unitary body.

The technical advantage of the present invention is that the string holes of the racket frame made of composite material are made during, not after, the molding process of the racket frame. In other words, a plurality of insertion pins are arranged in advance in the mold cavity in which the intended sports racket frame is to be made. In addition, the fiber cement is added to inner wall of the mold cavity adjacent to each insertion pin. The fiber cement so used is made from resin and short fiber which is identical in quality with that of the composite material used for making the racket frame. The added fiber cement and the layer of fiber fabric used to make the racket frame in the mold are therefore made into a unitary body during the blowing and hardening process under heat and pressure. Thereafter, the mold is opened to have the insertion pins removed so that the string holes are thus made in conjunction with the racket frame. Each of the string holes so made is composed of tubular support wall extending through the entire circumference of the string hole of the racket frame so as to reinforce the structural strength of the racket frame.

The present invention is further characterized in that the fiber cement is individually applied to an interspace located between each insertion pin and the inner wall of the mold cavity. The layer of fiber fabric therefore forms an arc portion along the mold wall on one side of insertion pins while the fiber cement added to other side of insertion pin is made into a cemented portion filling the gap formed between the arc portion and the inner wall of the mold cavity. In other words, the cemented portion and the arc portion make up the tubular support wall along the circumference of the string hole. Since the racket frame, the cemented portion, and the arc portion are all made from material of identical quality and are made into a unitary body, the overall structural strength of the racket frame of the present invention is greatly improved as compared with that of the prior art racket frames.

DETAILED DESCRIPTION OF THE PREFERRED EMBODIMENT

Figure 1:
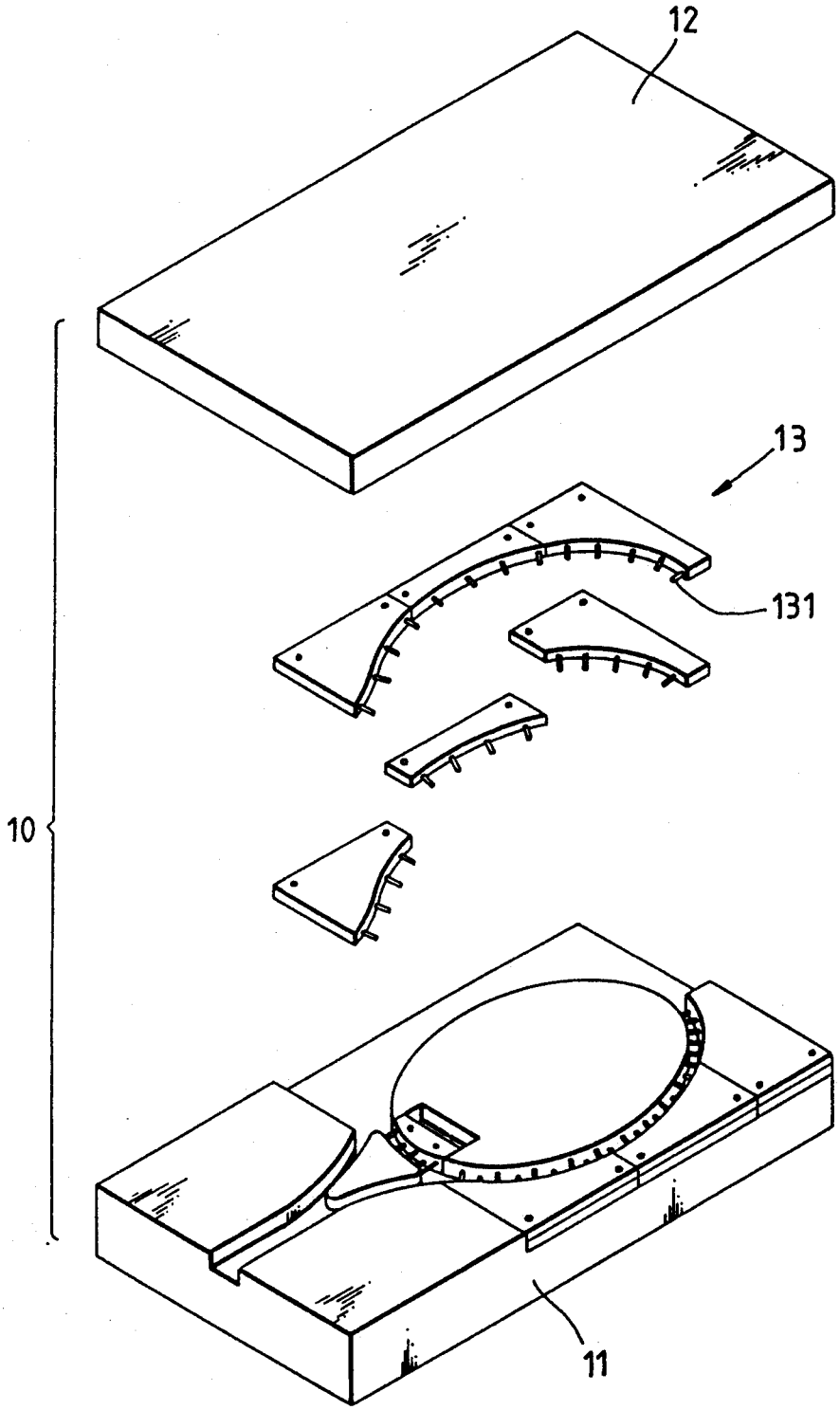
FIG. 1 shows a three-dimensional schematic view of the apparatus used to implement the present invention.
Figure 2:
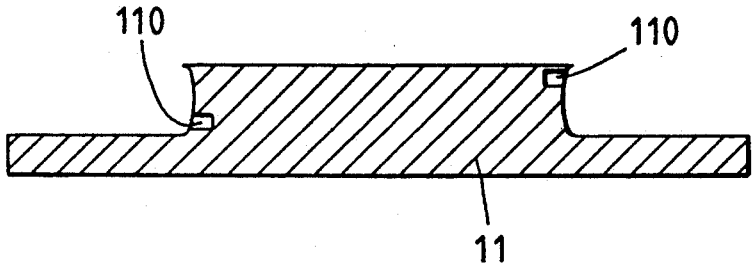
FIGS. 2–7 show a series of schematic views of implementing the present invention.

Referring to FIG. 1, the molding apparatus 10 of the present invention is shown comprising a lower mold 11, an upper mold 12, and a plurality of side molds 13 which can be properly arranged to form a mold cavity having the shape conforming to the shape of a sports racket frame intended to be made. The molding apparatus 10 is characterized in that lower mold 11 comprises a plurality of blind holes 110 arranged at equal intervals and on two different levels of the wall surface thereof facing the mold cavity, as shown in FIG. 2, and that side molds 13 are arranged therein in accordance with the shape of the head frame of the sports racket intended to be made, and further that each of side molds 13 consists of a plurality of insertion pins 131, whose positions correspond to those of blind holes 110 so that the head portions of insertion pins 131 can be placed into the corresponding blind holes 110, with the body portions of insertion pins 131 being remained in the mold cavity in which the head frame of the sports racket is formed. The distance separating each insertion pin 131 and adjacent lower mold 11 and adjacent upper mold 12 is in a range of 0.5–2.0 mm.

The implementing procedures of the present invention are illustrated hereinafter in conjunction with FIGS. 2–7.

As shown in FIG. 2 providing a cross-sectional view of the lower mold 11 comprising blind holes 110 positioned at different levels, the lower mold 11 is ready to be used as soon as a mold releasing agent is applied to various parts of the molding apparatus 10.

Figure 3:
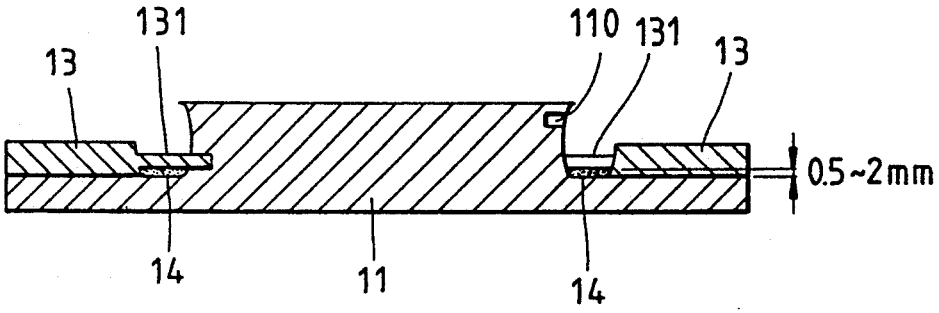

Now referring to FIG. 3, the lower level side mold 13 is shown being arranged on the lower mold 11 in such a manner that the insertion pin 131 thereof is placed into the corresponding blind hole 110. In addition, the interspace located between the insertion pin 131 and the wall surface of lower mold 11 is filled with the fiber cement 14 made from a mixture of short fiber and resin. The fiber cement 14 can be first applied to the body of insertion pin 131 of the lower level side mold 13. Thereafter, the side mold 13 is placed on the lower mold 11. If necessary, the lower level side mold 13 can be first placed on the lower mold 11, and then the fiber cement 14 is added to the gap located between the insertion pin 131 and the lower mold 11.

Figure 4:
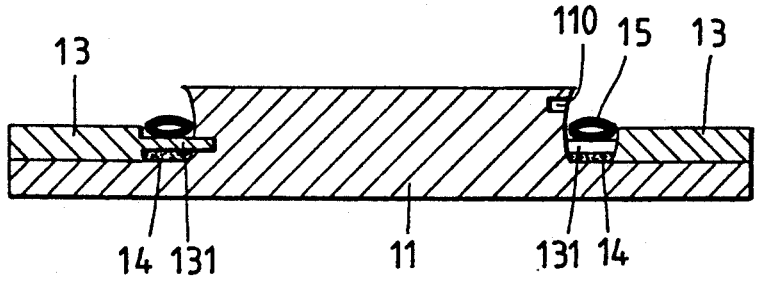

Referring to FIG. 4, a tubular strip 15 is shown being arranged in the area of mold cavity located between the lower mold 11 and the lower level side mold 13. The tubular strip 15 is made of a cellophane blow tube wrapped around with fiber fabric which is pre-impregnated with resin.

Figure 5:
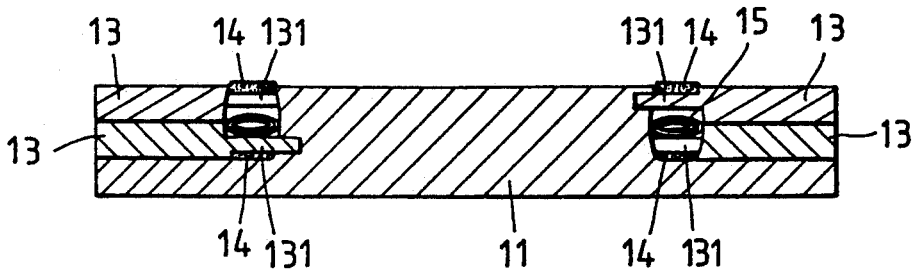

Now referring to FIG. 5, the upper level side mold 13 is arranged on the lower level side mold 13 in a manner that the insertion pin 131 thereof is inserted into the blind hole 110. The fiber cement 14 of predetermined quantity is applied to the naked portion of the insertion pin 131 of the upper level side mold 13.

Figure 6:
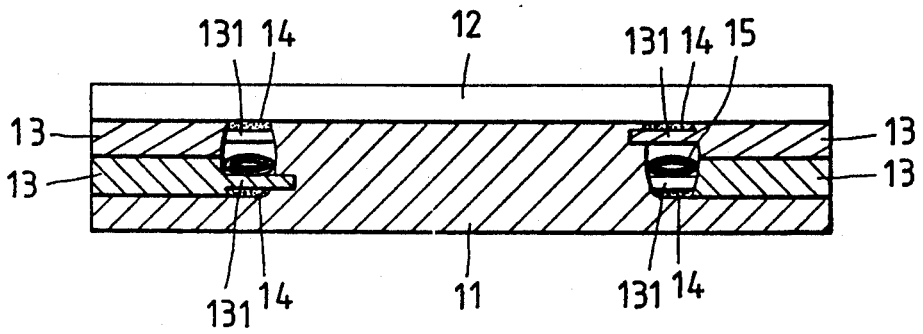

As shown in FIG. 6, the molding apparatus 10 is shown being covered with an upper mold 12. The covered molding apparatus 10 is subsequently placed in a thermo-pressure molding machine, in which the high-pressure gas is blown into the tubular strip 15 under pressure and heat.

Figure 7:
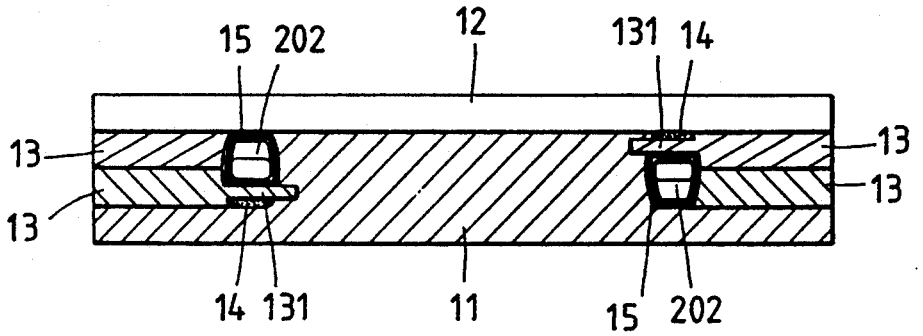
Figure 9:
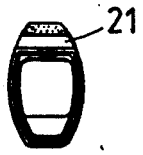
Figure 10:
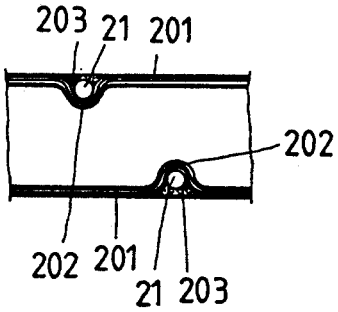

It is shown in FIG. 7 that the tubular strip 15 has expanded in such manners that the fiber fabric thereof is adhered to the wall surface of the mold cavity and that the fiber fabric thereof located at the place corresponding to the insertion pin 131 forms an arc portion 202, as shown in FIG. 10. The gap located between the insertion pin 131 and the inner wall surface of the mold cavity is filled with the fiber cement 14. After being heated under pressure for a predetermined period of time, the fiber cement 14 and the tubular strip 15 become hardened simultaneously to take shape. The molding apparatus 10 is then opened to remove therefrom a sports racket frame 20 having profiles such as those shown in FIGS. 8, 9, and 10. The technical aspects of forming a sports racket frame 20, such as temperature, pressure and time as required in the process, are similar to those of prior art and will not be therefore expounded here. It must be added here, however, that the optimum quantity of the fiber cement 14 applied to the gap as described above can be best determined by a trial-and-error approach on a case-by-case basis.

Figure 8:
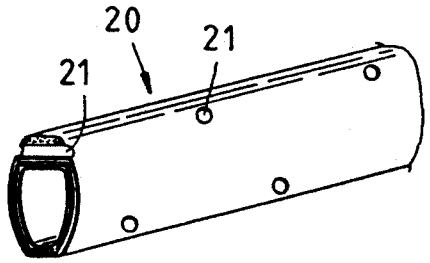
FIGS. 8–10 show schematic views of the structure of the string hole embodied in the racket frame of the present invention.

As shown in FIGS. 8-10, the sports racket frame 20 embodied in the present invention is characterized in that a plurality of arc portions 202 are formed at predetermined intervals along the both sides of the fiber fabric layer 201 which forms the head frame of the sports racket frame 20, and that the fiber cement 14, which is applied to the outer side of the arc portion 202, forms a cemented portion 203, and further that each arc portion 202 and each cemented portion 203 are made simultaneously and integrally as a unitary body. Furthermore, the string hole 21 of the sports racket frame 20 of the present invention comprises the tubular support wall, which is made up of the arc portion 202 and the cemented portion 203. The structural strength of the sports racket frame 20 of the present invention is not compromised by the arrangement of string holes 21 and is, in fact, enhanced by the string holes 21 which comprise therein the tubular support wall extending into the inner and the outer side walls 204 of the racket frame 20.

Figure 11:
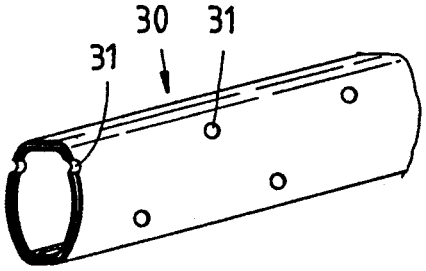
FIG.11 PRIOR ART
FIGS. 11–13 show schematic views of the structure of the string holes punched by a machine according to the implementing method of prior art.
Figure 12:
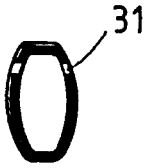
FIG.12 PRIOR ART
Figure 13:
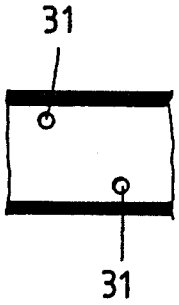
FIG.13 PRIOR ART

The innovative features of the structures of the sports racket frame 20, as illustrated in FIGS. 8-10, can be best appreciated by making a comparison between the sports racket frame 20 and the sports racket frame 30 made by a prior art method. The profiles of the string holes 31 of the sports racket frame 30 of prior art are shown in FIGS. 11-13. The external appearances of the sports racket frame 20 and the sports racket frame 30 look alike, as shown in FIGS. 8 and 11. However, a comparison of the two racket frames 20 and 30, as shown respectively in FIGS. 9 and 10 and FIGS. 12 and 13, suggests differences in that the sports racket frame 20 comprises arc portions 202 and cemented portions 203, which are made integrally as a unitary body to reinforce the structural strength of the sports racket frame 20. The advantage of the sports racket frame 20 of the present invention over the sports racket frame 30 of prior art is therefore readily apparent.

Figure 14:
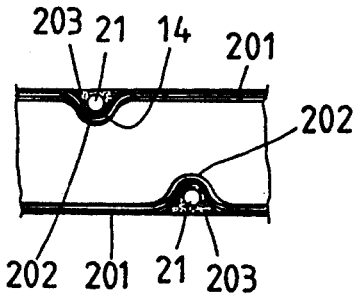
FIG. 14 shows another schematic view of the structure of the string hole embodied in the sports racket frame of the present invention.
Figure 15:
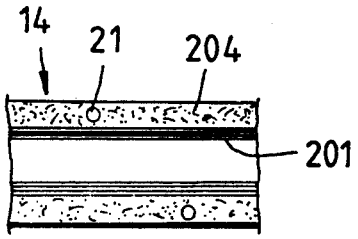
FIG. 15 shows still another schematic view of the structure of the string hole of the racket frame embodied in the present invention.
Figure 16:
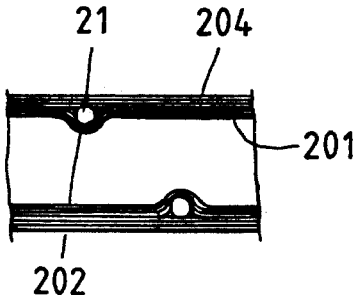
FIG. 16 shows still another schematic view of the structure of the string hole of the racket frame according to the present invention.

The embodiment of the present invention described above is to be considered in all respects as merely illustrative and not restrictive. Accordingly, the present invention may be embodied in other specific forms without deviating from the spirit thereof. For example, the string holes can be made even though the lower mold 11 is not provided with blind holes 110. The outer end of insertion pin 131 of the side mold 13 can be placed against and held on to the wall surface of the mold cavity of the lower mold 11. The fiber cement 14 can be applied to in such manners that it encloses the entire insertion pin 131 and that it is applied in a lesser amount to the fiber fabric layer adjacent to the insertion pin 131 so as to form a thinner cemented wall surface, as shown in FIG. 14. Furthermore, the fiber cement 14 can be applied to the entire area of the mold cavity in which the head frame of the sports racket frame takes shape. As a result, upper and lower cemented layers 204 are formed between the insertion pin 131 and the upper and the lower wall surfaces of the mold cavity. In such case, the arc portions 202 will not be formed by the tubular strip 15, and a cemented layer 204 is formed by the side of the fiber fabric layer 201, as shown in FIG. 15. The cemented layer 204 mentioned above can be formed by an elongated strip of fiber fabric preimpregnated with resin, rather than by fiber cement 14. The cemented layer 204 so formed is shown in FIG. 16.

What I claim is:

1. A method of making string holes integral with a sports racket frame made of composite material and composed of a head frame and a shaft portion including the steps of:

(a) placing a predetermined number of insertion pins in a circular groove forming a portion of the molding cavity for said head frame, said circular groove having an upper and lower wall surface, said insertion pins arranged at intervals in upper and lower rows, each said insertion pin crossing said circular groove and providing a clearance between said upper and lower wall surface adjacent thereto;

(b) filling said clearance with a fiber cement made from fiber and resin;

(c) placing a nylon blow tube wrapped by a fiber fabric made from said fiber and resin between said upper and lower rows of said insertion pins;

(d) blowing said nylon blow tube under heat and pressure to engage said fiber fabric to said fiber cement;

(e) curing said fiber fabric engaged to said fiber cement in said molding cavity; and (f) opening said molding cavity to remove therefrom said insertion pins and a formed sports racket frame comprising two rows of said string holes made integrally therewith and having openings on opposite side walls of said head frame, each of said string holes reinforced by a columnar support wall extending through the entire circumference of said string hole.

2. A method of making string holes integral with sports racket frame made of composite material according to claim 1, wherein said fiber cement is individually applied to said clearance between said insertion pin and said upper and lower wall surface of said molding cavity, wherein said nylon blow tube expands so that said fiber fabric adheres to said upper and lower wall surface of said mold cavity and forms an arcuate portion adjacent to said insertion pin, wherein said clearance between said insertion pin and said upper and lower wall surface of said molding cavity is filled with said fiber cement to form a cemented portion engaged to said arcuate portion.

3. A method of making string holes integral with sports racket frame made of composite material according to claim 1, wherein said fiber cement is applied around the circumference of said insertion pin to form said string holes and a columnar support wall integral with said fiber cement.

4. A method of making string holes integral with sports racket frame made of composite material according to claim 1, wherein said fiber cement is applied along said molding cavity in which said head frame is formed so that said fiber cement forms a cemented layer of shape consistent with shape of said head frame of said sports racket.

5. A method of making string holes integral with sports racket frame made of composite material according to claim 4, wherein said cemented layer is formed by a cemented strip placed between said insertion pin and said wall surface of said molding cavity, said cemented strip being made of long fiber fabric impregnated in resin.

6. A method of making string holes integral with sports racket frame made of composite material according to claim 1, wherein each said insertion pin is separately arranged in an upper or lower level in said molding cavity, with each of said insertion pin respectively remaining a distance ranging between 0.5 mm and 2.0 mm from an adjacent upper or lower wall surface of said molding cavity.

7. A method of making string holes integral with sports racket frame made of composite material according to claim 1, wherein said molding cavity is created by a lower mold, an upper mold, and a predetermined number of side molds, wherein said side molds are arranged in predetermined angles consistent with shape of said head frame, and are stacked to form upper and lower layers, each said side mold having a predetermined number of said insertion pins facing and pressing against a wall surface of said molding cavity.

8. A method of making string holes integral with sports racket frame made of composite material according to claim 7, wherein said lower layer side molds are first arranged at predetermined positions on said lower mold; wherein said clearance located between said insertion pin and a wall surface of said lower mold is filled with said fiber cement; wherein said columnar strip made of fiber fabric preimpregnated in resin is arranged in a place located between said lower mold and said lower layer side molds, with said lower layer side molds being stacked thereon by said upper layer side molds; wherein a naked portion of each of said insertion pins is provided thereon with a predetermined quantity of said fiber cement; and wherein said molding cavity with said upper mold covering thereon is treated under heat and pressure for a predetermined period of time so as to produce said sports racket frame comprising said string holes made integrally therewith.

9. A method of making string holes integral with sports racket frame made of composite material according to claim 8, wherein said lower molds are provided with blind holes arranged therebetween at predetermined interval in such a manner that they are lined up on said upper and lower levels of said wall surfaces of said lower molds, with said blind holes positioned correspondingly to said insertion pins.

* * * * *